US009738495B2

(12) United States Patent
Bohnacker et al.

(10) Patent No.: US 9,738,495 B2
(45) Date of Patent: Aug. 22, 2017

(54) LATTICE PIECE FOR A LATTICE BOOM, LATTICE BOOM AND CRANE

(71) Applicant: Liebherr-Werk Ehingen GmbH, Ehingen/Donau (DE)

(72) Inventors: Roland Bohnacker, Blaubeuren (DE); Ulrich Wiedemann, Ulm (DE); Thomas Klaiber, Neu-Ulm (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 51 days.

(21) Appl. No.: 14/740,377

(22) Filed: Jun. 16, 2015

(65) Prior Publication Data

US 2016/0016765 A1 Jan. 21, 2016

(30) Foreign Application Priority Data

Jun. 16, 2014 (DE) ..... 20 2014 004 888 U

(51) Int. Cl.
*B66C 23/64* (2006.01)
*B66C 23/70* (2006.01)

(52) U.S. Cl.
CPC ..... *B66C 23/64* (2013.01); *B66C 23/70* (2013.01)

(58) Field of Classification Search
CPC ..... B66C 23/00; B66C 23/06; B66C 23/26; B66C 23/36; B66C 23/365; B66C 23/62; B66C 23/64; B66C 23/66; E02F 9/14; E02F 3/38
See application file for complete search history.

(56) References Cited

U.S. PATENT DOCUMENTS 4,253,579 A * 3/1981 Williams ..... B66C 23/70 52/650.2

FOREIGN PATENT DOCUMENTS

DE 202008004663 UI 8/2009

* cited by examiner

*Primary Examiner* — Sang Kim
*Assistant Examiner* — Juan Campos, Jr.
(74) *Attorney, Agent, or Firm* — Dilworth & Barrese, LLP

(57) ABSTRACT

The present invention relates to a lattice piece for a crane boom comprising at least two lattice piece parts which are separably connected to one another in the longitudinal direction by means of one or more releasable connection points, wherein one or more lattice piece parts have one or more longitudinal tubes at least sectionally in the region of the connection points.

18 Claims, 14 Drawing Sheets

LATTICE PIECE FOR A LATTICE BOOM, LATTICE BOOM AND CRANE

BACKGROUND OF THE INVENTION

The invention relates to a lattice piece for a crane boom as well as to a lattice boom and to a crane having at least one such lattice piece.

Lattice booms are dimensioned and assembled in dependence on the application. The achievable lift height is fixed by the boom length, whereas the maximum payload depends inter alia on the boom strength. The lattice boom is composed of known lattice pieces which typically have a parallelepiped geometry. The longitudinal edges of the lattice pieces are connected to one another by four corner bars, wherein adjacent corner bars are connected to one another via diagonal members or unstrained members.

A possibility of increasing the payload comprises providing the assembled lattice pieces with larger dimensions so that the spacing between the corner bars and thus the diameter of the lattice pieces grows.

An alternative solution approach is known from DE 20 2008 004 663 U1 which proposes a multi-strand boom design. The lattice mast boom proposed therein is in detail composed of a first and a second region, wherein the first region comprises at least two strands from lattice pieces and the second region comprises a single strand formed from lattice pieces.

Due to the number of lattice pieces used in the assembled lattice boom of this utility model specification, the resulting boom weight is, however, very high, which puts a great strain on the crane and which has to be taken into account in the determination of the load capacity.

SUMMARY OF THE INVENTION

The object of the present invention now comprises providing a solution for an alternative configuration of a lattice piece which allows the design of a lattice boom which is able to overcome the above problems.

This object is achieved by a lattice piece having the features herein. Advantageous embodiments of the lattice piece are the subject of the features herein.

In accordance with the invention, a lattice piece for a crane boom is proposed which comprises at least two lattice piece parts which are separably connected to one another in the longitudinal direction by means of one or more releasable connection points.

There is now the possibility in accordance with the invention due to the releasable connection of the two lattice piece parts of flexibly joining the at least two lattice piece parts together, i.e. either to connect them immediately directly to one another or alternatively to connect them using a spacer element in order thus to be able to vary the resulting lattice piece cross-section as required.

Provision is made in accordance with the invention for stability reasons that one or more lattice piece parts have one or more longitudinal tubes at least sectionally in the region of the connection points. The longitudinal tubes extend in the longitudinal direction of the lattice piece and thus form longitudinal edges of the parallelepiped lattice piece part. An assembly possibility using one or more interposed spacer elements is provided due to the stability of the lattice piece parts thereby gained. A flexible possibility of adapting the individual lattice pieces to the boom assembly results. A lattice piece is produced with a variable diameter, in particular a variable width. A boom structure assembled from individual lattice pieces can thereby be dimensioned in dependence on the application to configure the crane for larger payloads as required.

It is, for example, conceivable that one or more lattice pieces parts can be connected to one another via one or more spacer bars. On a use of a plurality of spacer bars, it is expedient to assemble them in the longitudinal direction of the lattice piece parts, for example such that two lattice piece parts are connected one another via a respective one spacer bar in their sections at the bottom and at the top viewed in the longitudinal direction.

In an advantageous embodiment of the invention, the at least one spacer bar is of parallelepiped shape. The structure of the spacer bar can be of an areal design; however, for weight reasons, a variant is preferably expedient which only has a spatial structure with as low surface portion. A parallelepiped shape is, for example, conceivable whose longitudinal edges are formed by longitudinal bars, in particular by four longitudinal bars, which extend transversely to the longitudinal axis of the lattice piece and which are preferably connected at the end side to the lattice piece parts to be connected. The longitudinal bars are connected to one another via one or more diagonal members and/or transverse members; an end-side fastening of the transverse members to the longitudinal bars is preferred. This is only one embodiment variant of the spacer bars; however, any different structure is conceivable which gives the resulting lattice piece having a larger diameter the required stability and strength.

In a preferred embodiment the invention, the one or more longitudinal tubes of a lattice piece part are connected to at least one corner bar of the same lattice piece part via one or more unstrained members and/or diagonal members. A possible design variant of the lattice piece parts comprises the fact that it has two outwardly disposed adjacent corner bars which are each connected to corresponding longitudinal tubes via one or more unstrained members and/or diagonal members. At least one of the lattice pieces is thereby likewise given a parallelepiped shape whose outwardly disposed longitudinal edges are formed by the corner bars and their inwardly disposed longitudinal edges are formed by longitudinal tubes.

The lattice piece parts of a lattice piece can be identical or almost identical, preferably apart from differences in the specific embodiment of the connection points. However, nor does anything speak against different lattice piece part designs.

The one or more required connection points for connecting the two or more lattice piece parts can be formed either at the end of one or more unstrained members of the lattice piece or/and at the longitudinal tubes of the lattice piece part. If the connection points are shaped at the end side at one or more unstrained members, the arranged longitudinal tubes can be interrupted in the longitudinal direction by the one or more unstrained members or connection points.

One or more of the aforesaid connection points can able to be pinned and can in particular be configured as fork-finger connection having pluggable pins. Alternatively, multi-sectioned connections or dovetail-like connections could also be used.

It may be sensible for the weight-optimized design of the lattice pieces in accordance with the invention that the corner bards of the individual lattice piece parts have larger dimensions than their longitudinal tubes. Since the strain on the corner bards is larger, weight can be saved by the smaller dimensions of the longitudinal tubes. The longitudinal tubes used in particular have smaller dimensions with respect to their diameters.

In addition to the lattice piece, the present invention furthermore relates to a lattice boom having at least one lattice piece in accordance with the present invention or an advantageous embodiment of the invention. The claimed lattice boom is preferably a boom luffable in the vertical luffing plane. The advantages and properties of the lattice boom in accordance with the invention obviously correspond to those of the lattice piece in accordance with the invention so that a repeat description will be dispensed with at this point.

Provision is made in a particularly preferred embodiment of the lattice boom in accordance with the invention that it has at least once first boom region and at least one second boom region, wherein the lattice boom in the first region comprises one or more of the lattice pieces in accordance with the invention whose lattice piece parts are connected to one another via first spacer bars and wherein in the second region one or more conventional lattice pieces and/or lattice pieces in accordance with the invention are provided whose lattice piece parts are directly connected to one another or are connected to spacer bars which are shorter with respect to the first spacer bars. The embodiment of the lattice pieces in accordance with the invention which are used opens up the possibility of configuring the lattice boom with a flexible cross-sectional surface in the longitudinal direction. The lattice boom can thereby be adapted more flexibly to the respective payload and to external influences.

In contrast to DE 20 2008 004 663, it is thus no longer necessary to work with two parallel boom strands, but the boom can rather be assembled with widened lattice pieces in critical regions. The advantages of the prior art can thereby be achieved, with the boom design in accordance with the invention, however, being of lightweight construction, which additionally optimizes the crane with respect to its payload.

The crane boom is not limited to two regions so hat booms having more than two different regions with different boom cross-sections are conceivable.

A further substantial advantage of the present invention comprises the fact that the "pseudo-boom strands" are connected to one another in contrast to designs known from the prior art. The additional area disposed between the strands provides the boom with a higher stability and counteracts engaging torsion strains.

Different boom regions can ideally be connected in the longitudinal direction via suitable traverse members and/or modified lattice pieces. The pivot boom connection to the crane superstructure can take place by means of a modified pivotal connection piece.

One or more lattice pieces of different dimensions can be transported stored inside one another for the crane transport. The dismantling of the lattice pieces into a plurality of individual parts is also conceivable for transportation purposes. Lattice piece parts can likewise be stored in the hollow space of conventional lattice pieces, for example. The reception of one or more heavy crane assemblies in the interior of the lattice pieces is also conceivable for transportation purposes.

Finally, the present invention relates to a crane, in particular to a mobile crane, having a lattice boom in accordance with the present invention or in accordance with an advantageous embodiment of the present invention. The advantages and properties of the crane correspond to those of the lattice boom in accordance with the invention so that a repeat description will be dispensed with at this point.

BRIEF DESCRIPTION OF THE DRAWINGS

Further advantages and properties of the invention will be explained below in more detail with reference to an embodiment shown in the drawings. There are shown.

DESCRIPTION OF THE PREFERRED EMBODIMENTS

Figure 1A:
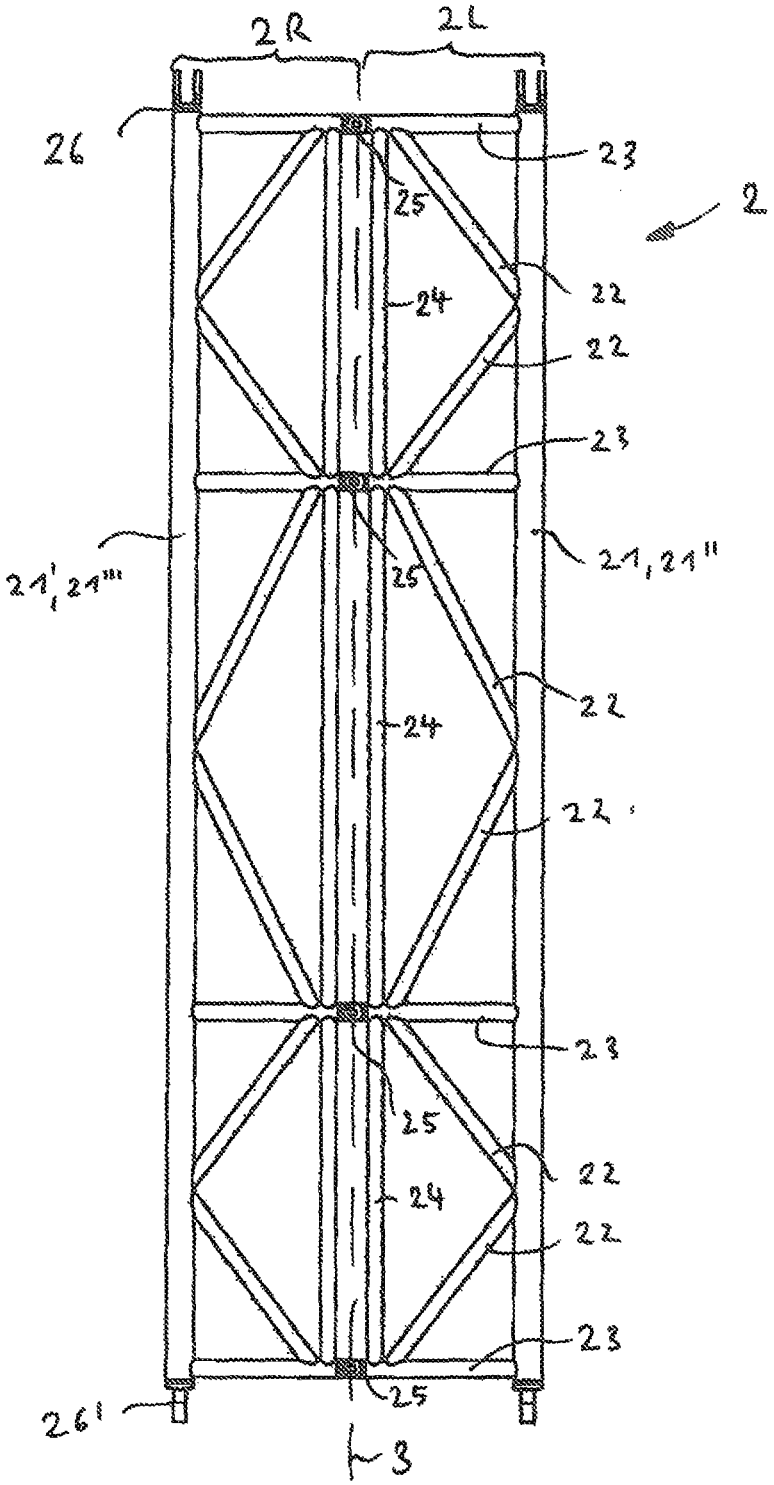
FIGS. 1*a*-1*c*: different views of the lattice piece in accordance with the invention.
Figure 1B:
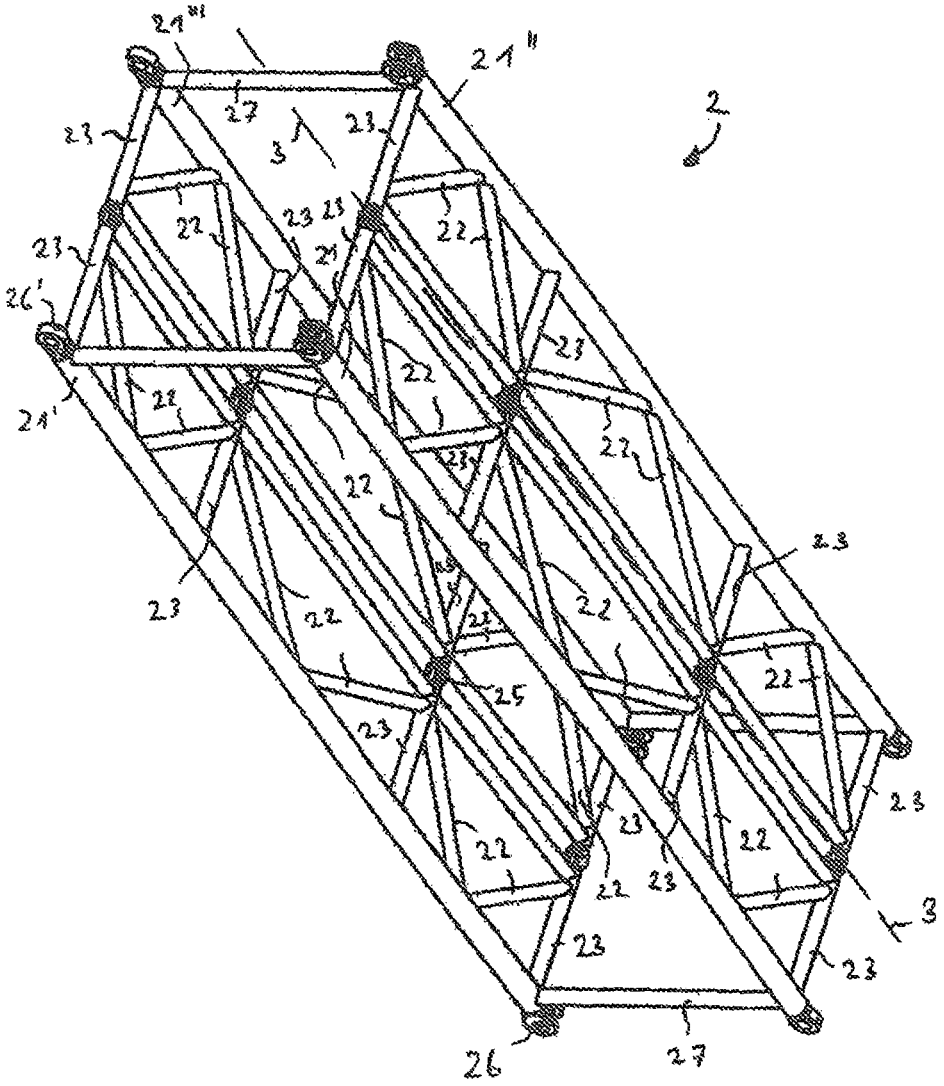

FIGS. 1*a*, 1*b* show different views of the lattice piece 2 in accordance with the invention. The lattice piece structure in accordance with the invention allows a flexible adaptation of the width of the lattice piece, in particular of its width transversely to the vertical luffing plane of the assembled lattice boom. Different boom types can thereby be assembled, wherein the construction of the lattice piece 2*s* in accordance with the invention results in a weight saving with respect to conventional lattice piece types.

The lattice piece 2 is designed as separable and can be dismantled along the luffing plane 3 of the assembled boom into the two lattice piece halves 2R and 2L. The structure of the lattice piece can be seen from the perspective representation of FIG. 1*b* and comprises in a typical manner four corner bars 21, 21', 21", 21'" which form the longitudinal edges of the parallelepiped lattice piece geometry. The corner bars 21, 21', 21", 21'" are connected at the end sides via two respective throughgoing unstrained members 27 extending in parallel with the luffing plane 3. All the unstrained members 23 and/or diagonals 22 extending transversely to the luffing plane are designed as separable, wherein the segments of the unstrained members 23 and/or of the diagonals 22 are releasably connected to one another via connection points 25. The lattice piece 2 is divided into the halves 2R, 2L by releasing the connections.

In the region of the connection points 25, i.e. along the luffing plane 3, each lattice piece half 2R, 2L comprises two longitudinal tubes 24 which are divided by the unstrained members 23 into three longitudinal tube segments per side of the lattice piece halves and which are fastened to the unstrained members. The total lattice piece 2 thus comprises a total of four longitudinal tubes 24 or twelve longitudinal tube segments. The adjacent corner bars 21, 21" as well as 21', 21'" are, in contrast to conventional lattice pieces, no longer directly connected to one another via unstrained members and diagonal members, but rather instead via the connection points 25 in the region of the longitudinal tubes 24.

Furthermore, diagonal members 22 extend from the corner bars 21, 21' 21", 21'" in the direction of the end of the unstrained members 23 having the connection point 25, with them being arranged above the longitudinal tubes 24 at the unstrained members 23 to form the known triangular structure for each lattice piece half 2R, 2L. For the better clarity of the Figures, the unstrained members and the diagonal members in the lateral surfaces in parallel with the luffing plane 3 of the lattice piece are not drawn.

The connection points 25 are designed in the form of a releasable connection, in particular of a fork-finger connection, whose connection means, in particular pins, can simply be drawn to separate the connection.

Figure 1C:
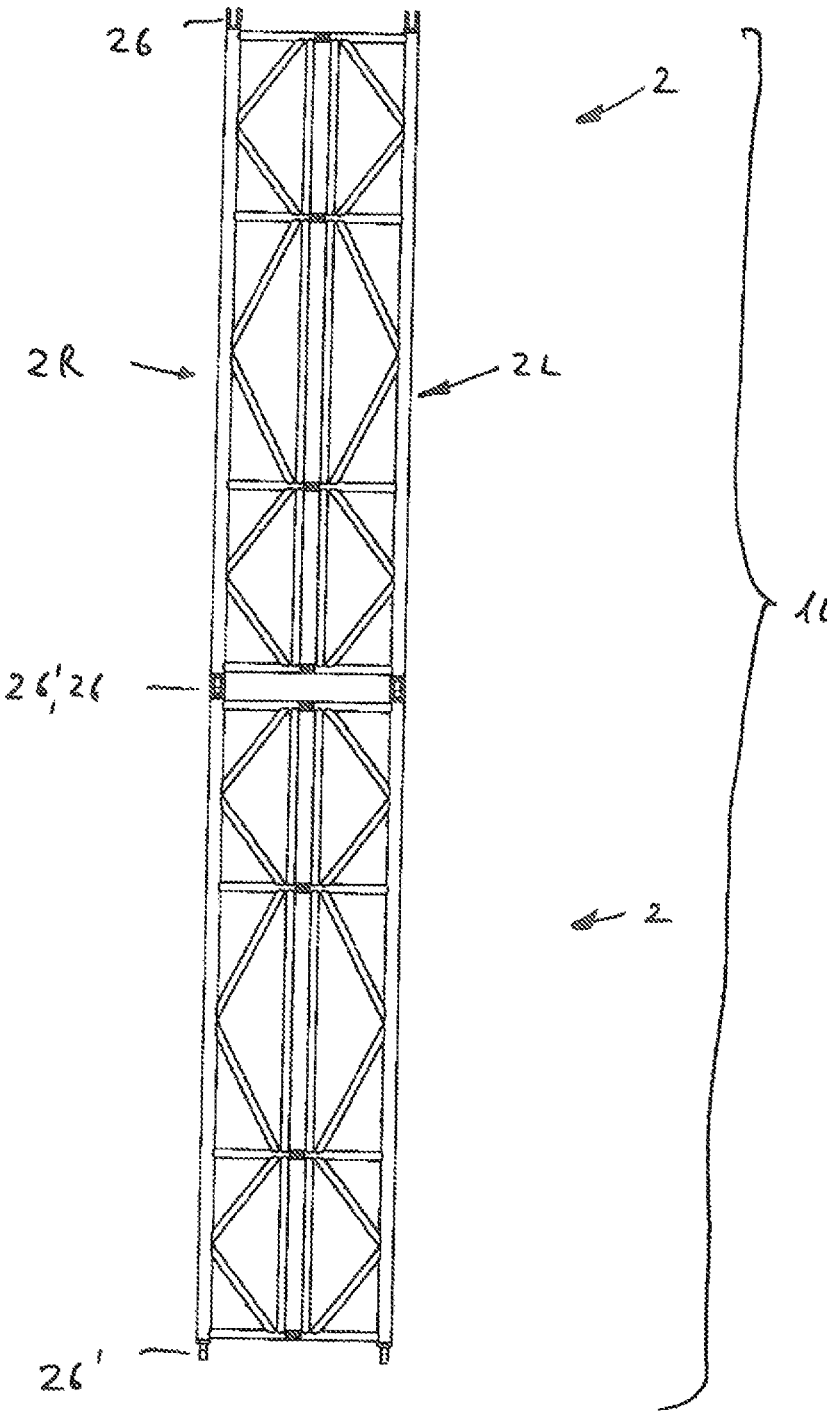

Further connection points 26, 26' are provided at the end side at the lattice piece 2 to connect a plurality of lattice pieces 2 of the described shape to one another in a longitudinal direction. FIG. 1*c* illustrates a boom segment 10 of two mutually connected lattice pieces 2. The connections 26, 26' are also implemented as releasable connections, in particular as known fork-finger connections.

It can furthermore be seen from FIGS. 1*a* to 1*c* that the corner bars 21, 21' 21", 21'" have much larger dimensions than the integrated longitudinal tubes 24. A weight saving is thereby achieved.

In accordance with the invention, using the lattice piece halves 2L, 2R, a crane can also be set up for lifting an exceptionally heavy load or having an exceptionally high load torque. For this purpose, the lattice piece halves 2L, 2R are not directly connected to one another, but rather via one or more spacer bars 30, as can easily be recognized in FIGS. 2*a*, 2*b*. The reception of the spacer bars 30 between the lattice piece halves widens them transversely to the luffing plane 3. The created lattice piece is called a heavy lattice piece 2S.

Figure 2A:
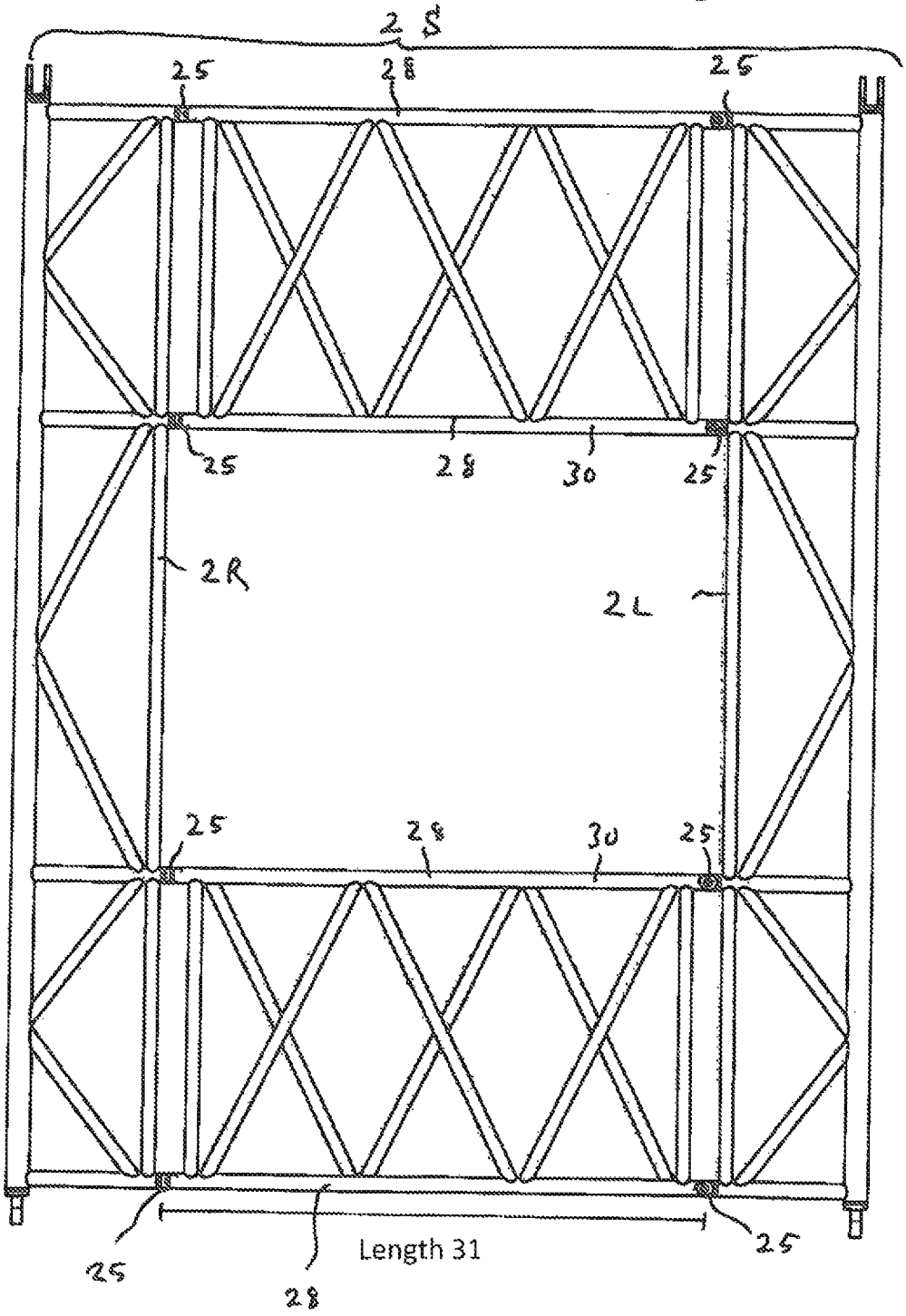
FIGS. 2*a*-2*c*: different views of the lattice piece in accordance with the invention with inserted spacer bars.
Figure 2B:
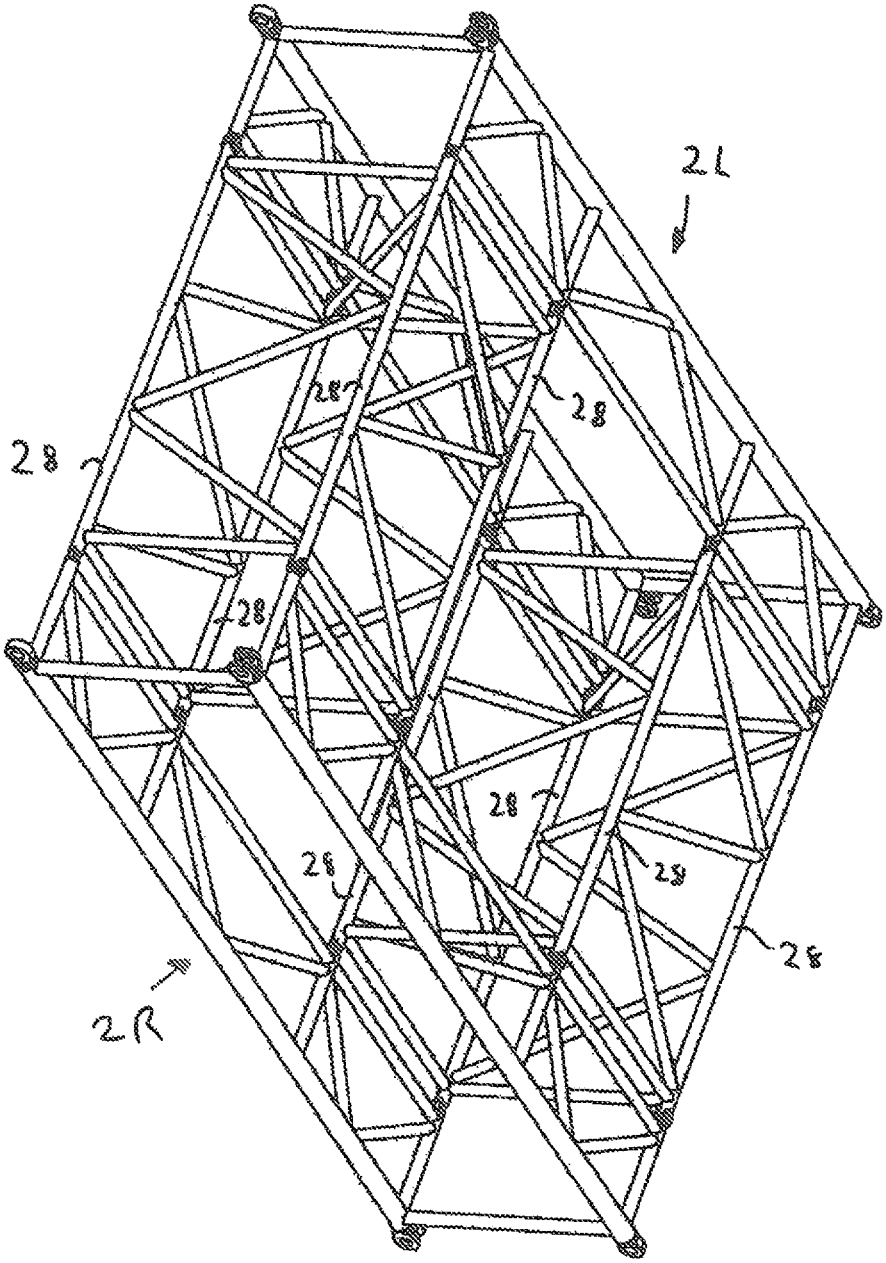

It can be recognized here, with reference to FIG. 2*b*, that the spacer bars 30 are arranged in the upper and lower regions of the lattice piece halves 2R, 2L; the interposed space remains free. The spacer bars 30 used likewise have a parallelepiped shape whose side surfaces comprise the known triangular geometry of unstrained members and diagonal members. The length of the spacer bars is selected the same per lattice piece 2 and is marked by the reference numeral 31 in FIG. 2*a*. The width of the lattice piece transversely to the luffing plane 3 consequently widens by the length 31 due to the use of the spacer bars 30. At least a doubling of the system width can ideally be achieved by the installation of spacer bars 30.

The longitudinal edges of the spacer bars 30 are formed by the longitudinal bars 28 whose ends form matching counter points 25 for the fork-finger connection 25 of the two lattice piece halves 2R, 2L. The spacing of adjacent longitudinal bars 28 in this respect coincides with the spacing of the connection points of the lattice piece halves 2R, 2L.

Figure 2C:
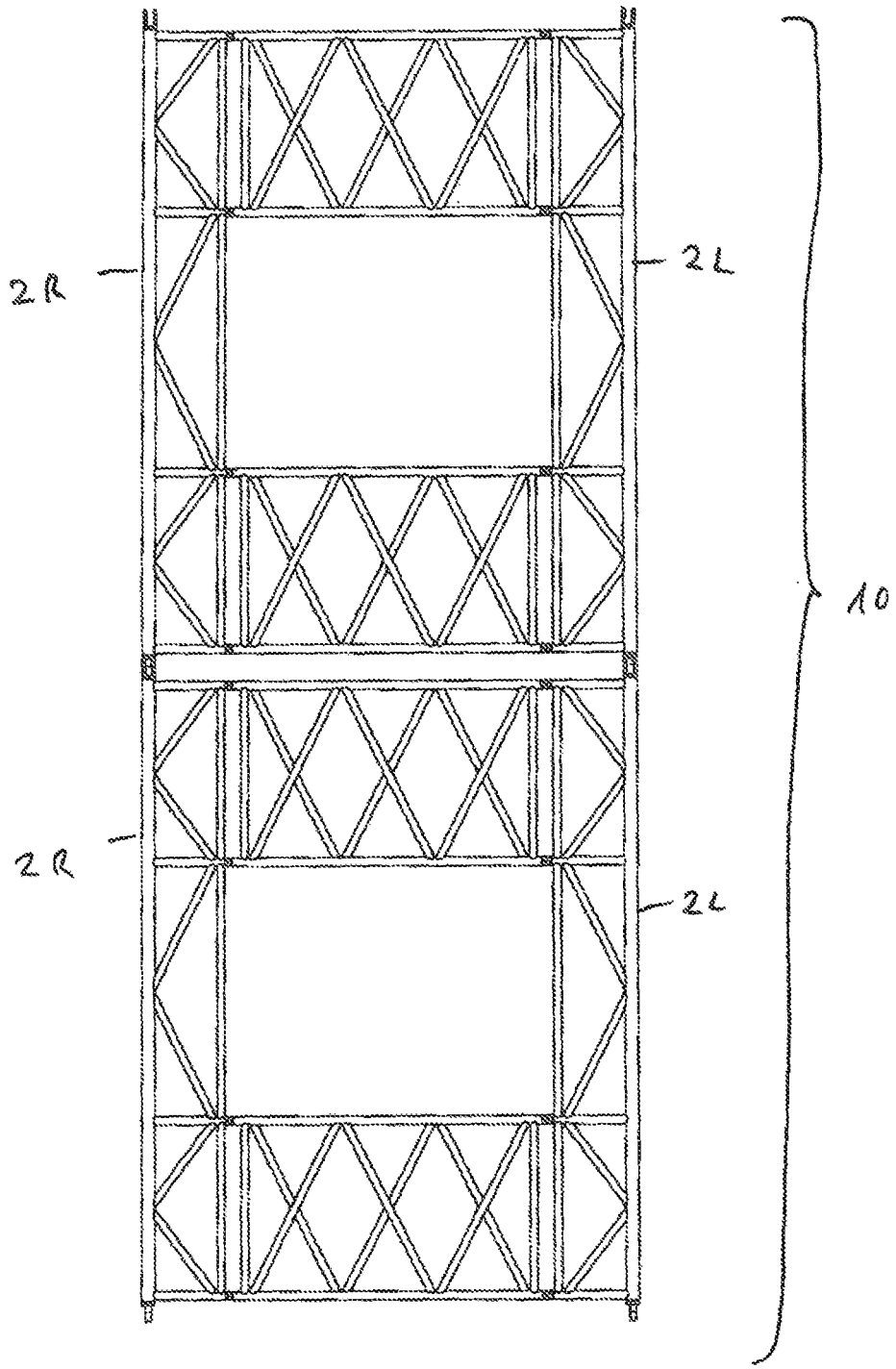

As can be seen from FIG. 2*c*, individual heavy lattice pieces 2S can be connected to one another to form a boom 10 or a boom section. The aim and purpose of these heavy lattice pieces 2S is to optimize a lattice boom 10 for higher payloads and furthermore to construct it more robustly toward external influences as in DE 20 2008 004 663 U1.

Figure 3A:
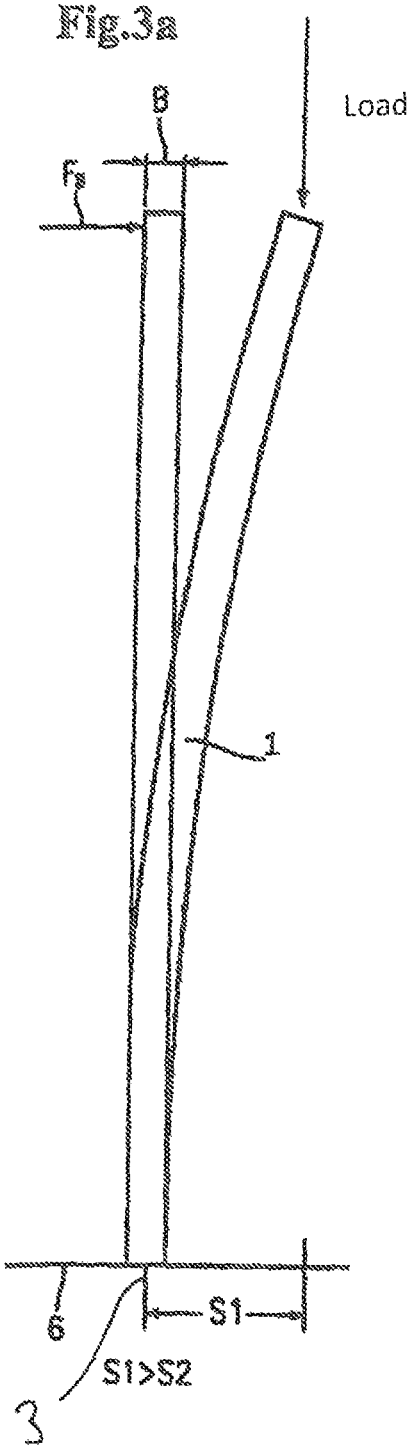
FIGS. 3*a*-3*b*: schematic front views of a lattice boom to explain the basic problem which underlies the present invention.
Figure 3B:
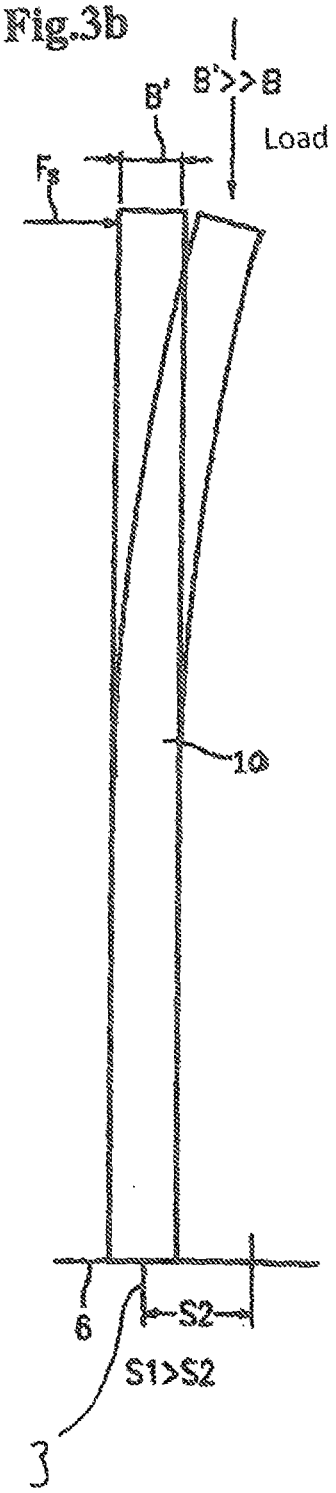

In known lattice mast cranes, the lattice mast boom is typically held by guying ropes on luffing. The decisive criterion for the peak payloads in a steep position is therefore not the deflection of the boom in the luffing plane 3 with lattice mast booms when lifting large loads, but rather the side deformation perpendicular to the luffing plane 3 as can be shown with reference to FIG. 3*a* and FIG. 3*b*. The front view of two lattice booms 1, 10 of different widths B, B' is shown schematically here. In this respect, FIG. 3*a* shows a lattice mast boom 1 which is luffable about the luffing axis 6 in a plane 3 perpendicular to the plane of the drawing. FIG. 3*b* shows a lattice mast boom 10 which is likewise luffable about the luffing axis 6 in a plane 3 perpendicular to the plane of the drawing. If the lattice mast boom 1 of the width B shown in FIG. 3*a* in this respect undergoes a lateral deflection S1 still without load by a laterally acting force $F_s$, for example by a wind force, the lifting of a load with the already present deflection S1 effects a large lateral torque.

If, as shown in FIG. 3*b*, a lattice mast boom 10 is used having a width B' which is larger than B, the case improves since the lattice mast boom is deformed less by the laterally acting force $F_s$ and thus only undergoes a lateral deflection S2<S1. The lateral torque is accordingly also smaller. In addition, the increased width increases the stiffness of the lattice mast boom 10 with respect to the lateral torque produced by the load.

The width of the boom 10 can be adapted flexibly to the respective application by the configuration of the lattice piece 2 in accordance with the invention and an optimization with respect to the payload in accordance with FIG. 3*b* can be achieved with respect to the prior art.

In detail, the boom 10 is preferably designed in the lower region, that is close to the luffing axis 6, very resistant to deflections from the luffing plane 3. This is achieved in detail in that the wall thicknesses of the corner bars 21, 21', 21", 22'" are increased, whereas the wall thicknesses of the longitudinal tubes 24 are kept small. Depending on the deployment case, the length 31 of the spacer bars 30 is selected such that a maximum lateral deflection S2 can be observed due to the resulting width B'. Large lengths 31 in this respect take up a lot of space at the construction site, but bring about a great gain in the maximum payload since the corner bars 21, 21', 21", 21'" are far remote from the luffing plane 3. The lattice boom 10 is only deflected a little out of the luffing plane 3.

The heavy lattice pieces 2S are preferably attached in the lower region of the lattice boom 10. Lighter lattice pieces 2 are installed in the upper region of the lattice boom 10. They can be the separable lattice pieces 2 without additional spacer bars 30 or can be conventional lattice pieces. There is naturally equally the possibility of assembling the boom 10 from more than two different sections.

In accordance with the embodiment shown in accordance with FIG. 3*b*, the first two or three lattice pieces can be designed as heavy lattice pieces 2S, whereby a lot of weight close to the luffing axis 6 is invested in a lower deflection of the lattice boom 10 in the lower region. Weight is saved in the upper region of the boom 10 and the boom 10 is deliberately kept light.

The different regions of the boom 10 having different lattice pieces 2 can be connected to one another via corresponding traverses. The pivotal connection to the superstructure of the crane can take place via a modified pivotal connection piece or via a modified lattice piece. This used special element is then to be adapted to the system width currently to be set up, for example in the range from 2 m to 2 m+2 m.

The lattice pieces 2 in accordance with the invention can be of a similar length in comparison with lattice pieces from the prior art, for example, in the range between 6 m to 14 m. For transportation, a lattice piece half 2L, 2R could then be transported in two lattice pieces from the prior art.

The connection between each lattice piece half 2L, 2R and the spacer bar 30 has to be designed as rigid as possible. For this reason, at least two connection points 25, at least four where possible, are provided between the respective elements 2R, 2L, 30. It is theoretically likewise conceivable that the spacer bar or bars 30 is/are used at a different point of the crane, in particular in the boom system, if they are not used as the actual spacer bar between the lattice piece halves 2L, 2R.

The lattice piece 2 may not become torsionally softer due to the connection points 25 than a conventional lattice piece having the same dimensions. It can be necessary for this reason to rework the respective connection parts 25 mechanically.

A substantial advantage of the lattice boom 10 in accordance with the invention having a mixed setup of heavy lattice pieces 2S and simple lattice pieces 2 with respect to the two-strand boom in accordance with DE 20 2008 004 663 U1 will be explained with reference to FIGS. 4, 5.

Figure 4:
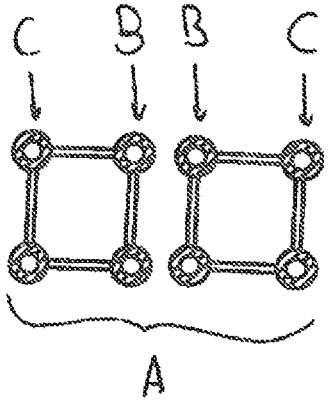
Fig.4 Prior Art
FIG. 4: a cross-sectional view of a two-strand boom known from the prior art.

FIG. 4 shows a cross-section through the two-strand boom structure such as is known from the prior art. The torsional moment of inertia is proportional to the square of the enclosed area of the cross-section at the lattice boom 1. In the case of FIG. 4, the torsional moment of inertia is composed of the sum of the individual torsional moments of inertia (here the rectangle between B and C). Since the composite is broken up, the surface disposed between the strands, i.e. the surface between the corner bars B, is not supporting.

Figure 5:
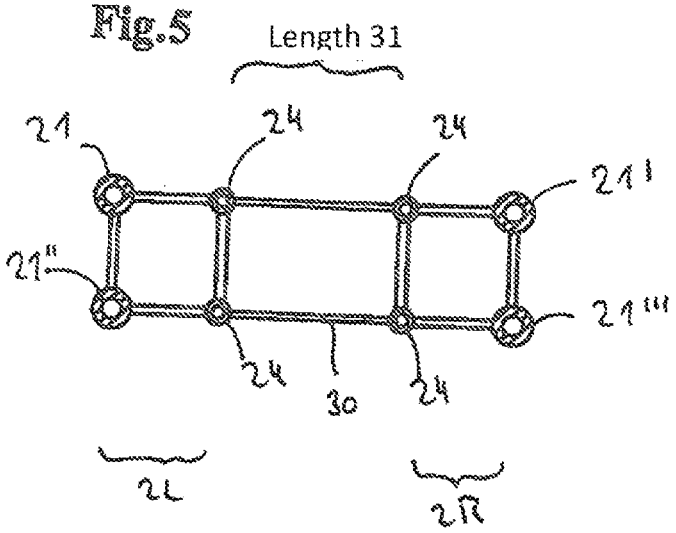
FIG. 5: a cross-sectional view of the lattice boom in accordance with the invention with an inserted spacer bar.

FIG. 5 shows the solution in accordance with the invention of the boom 10 having heavy lattice pieces 2S. Since the surface surrounded by the outer corner bars 21, 21', 21", 21'" makes a peripheral thrust flow possible in the solution in accordance with the invention, the torsional moment of inertia hereby increases disproportionally.

Figure 6A:
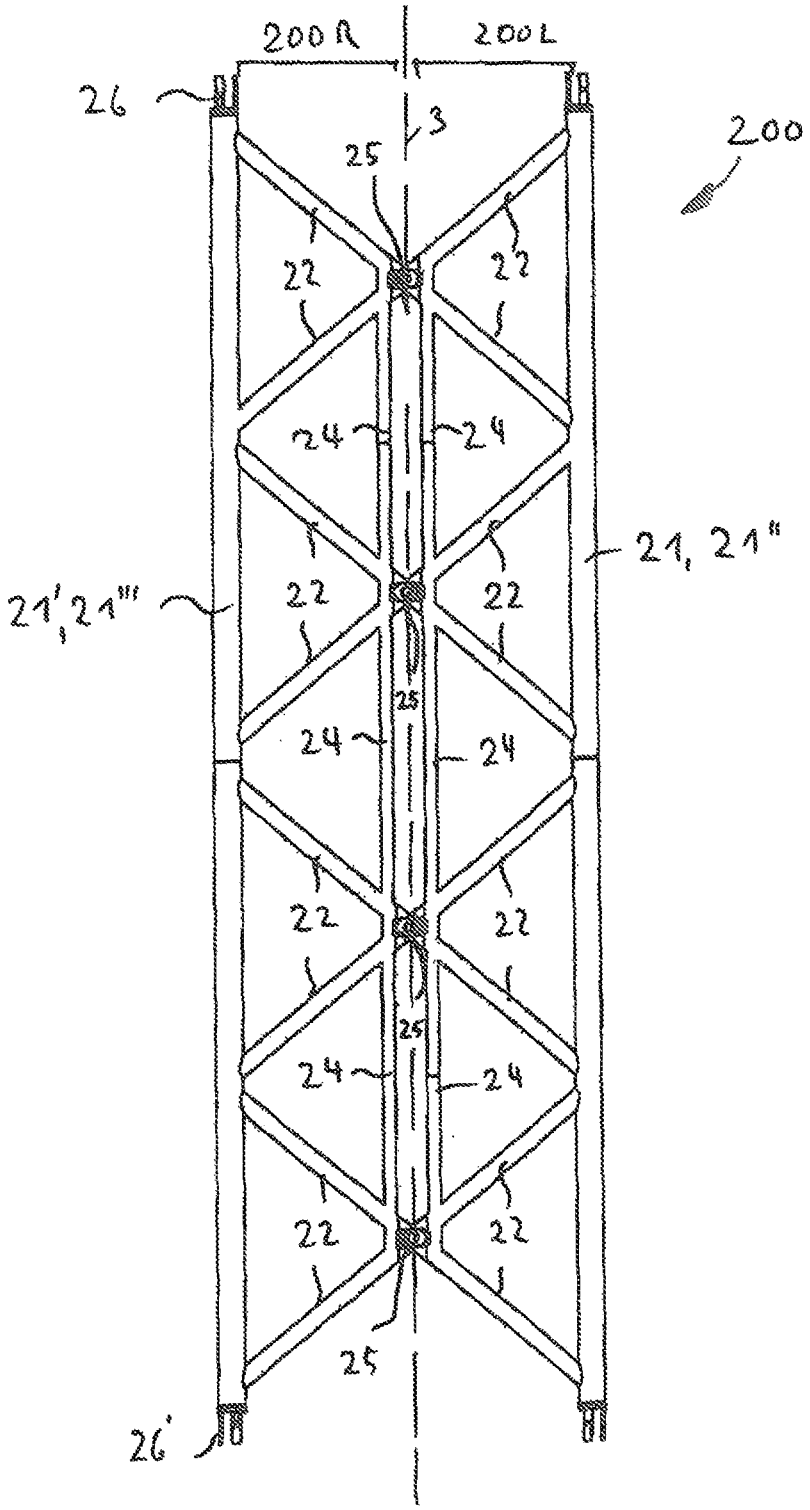
FIGS. 6*a*-6*c*: different views of the lattice piece in accordance with the invention in accordance with an alternative embodiment.
Figure 6B:
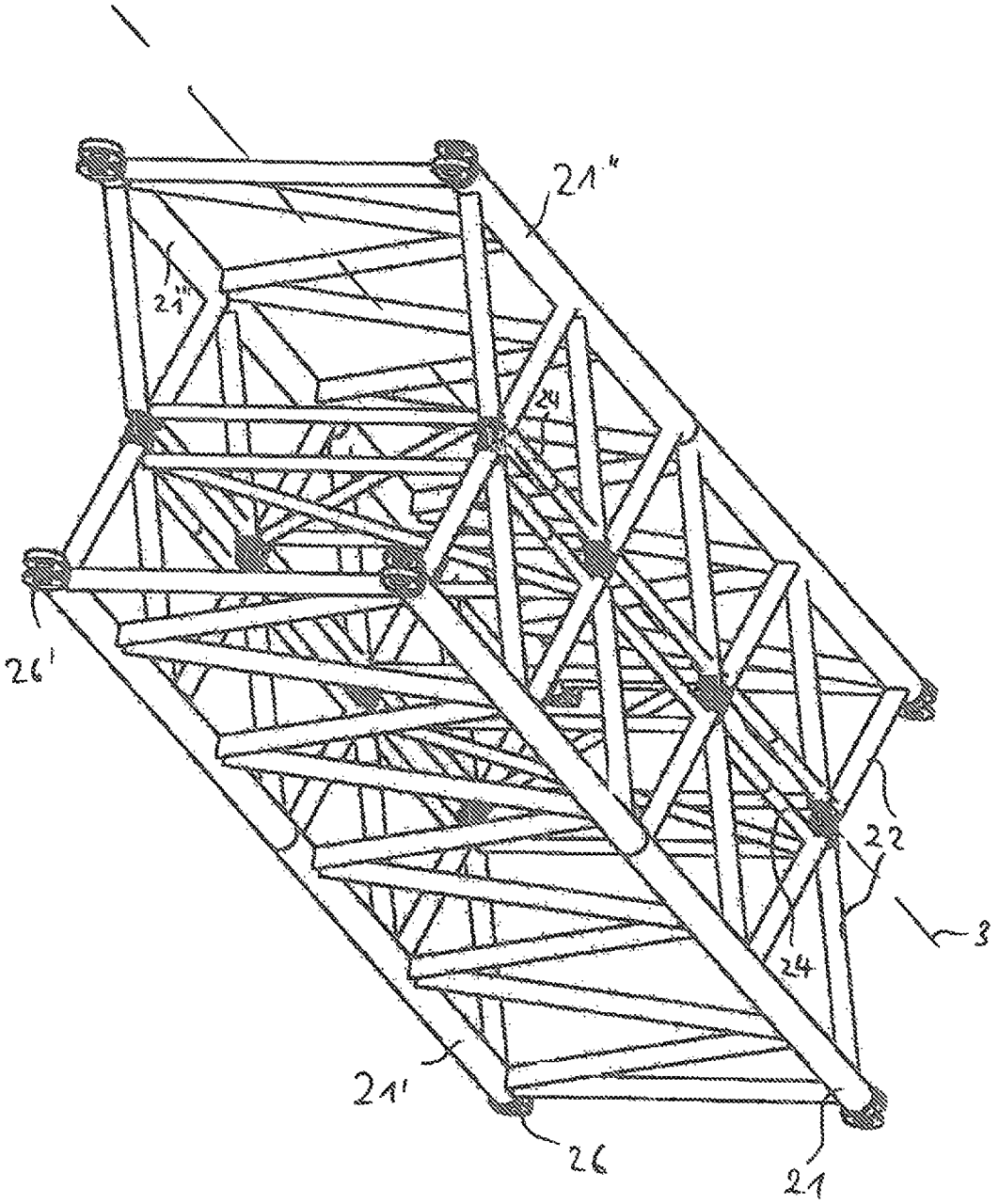
Figure 6C:
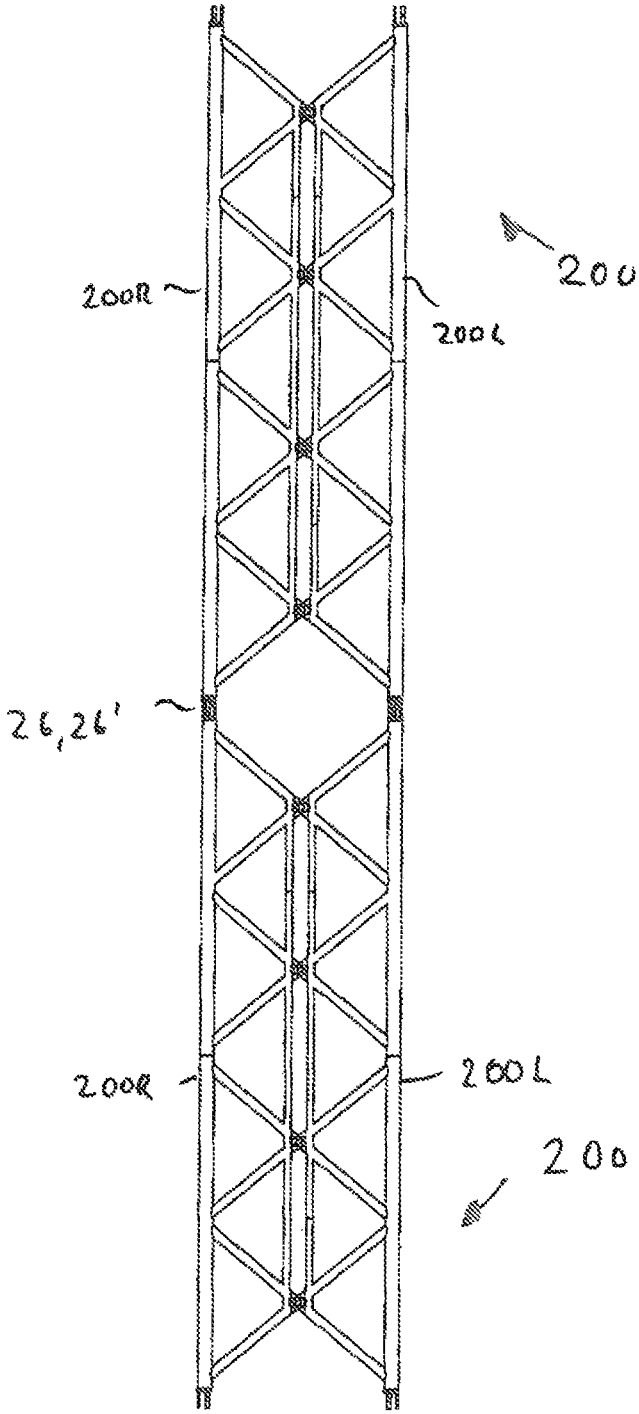

FIGS. 6*a*-6*c* show a further embodiment of the lattice piece 200 in accordance with the invention. These representations substantially correspond to the representation of FIGS. 1*a* to 1*c*, wherein identical components or assemblies are marked by the same reference numerals. Only the differences will therefore be looked at in the following. The lattice piece 200 also comprises the separable lattice piece halves 200L and 200R. Differing from the first embodiment, the design in accordance with FIGS. 1*a* to 1*c* dispenses with the unstrained members. The longitudinal tubes extending along the luffing plane 3 in the region of the connection points are, ???but the longitudinal tubes 24 are divided by the diagonal members 22 into three longitudinal tube segments per side of the lattice piece halves 200L, 200R and are fastened to the diagonal members 22. The total lattice piece 200 thus comprises a total of four longitudinal tubes 24 or twelve longitudinal tube segments. The adjacent corner bars 21, 21" as well as 21', 21'" are, in contrast to conventional lattice pieces, no longer directly connected to one another via unstrained members and diagonal members, but rather instead via the connection points 25 in the region of the longitudinal tubes 24.

It can furthermore be recognized that in the embodiment of FIGS. 6*a* to 6*c*, the longitudinal tubes 24 are shorter than the corner bars 21, 21', 21", 21'", whereby advantages result in the force flow and in the weight.

Figure 7A:
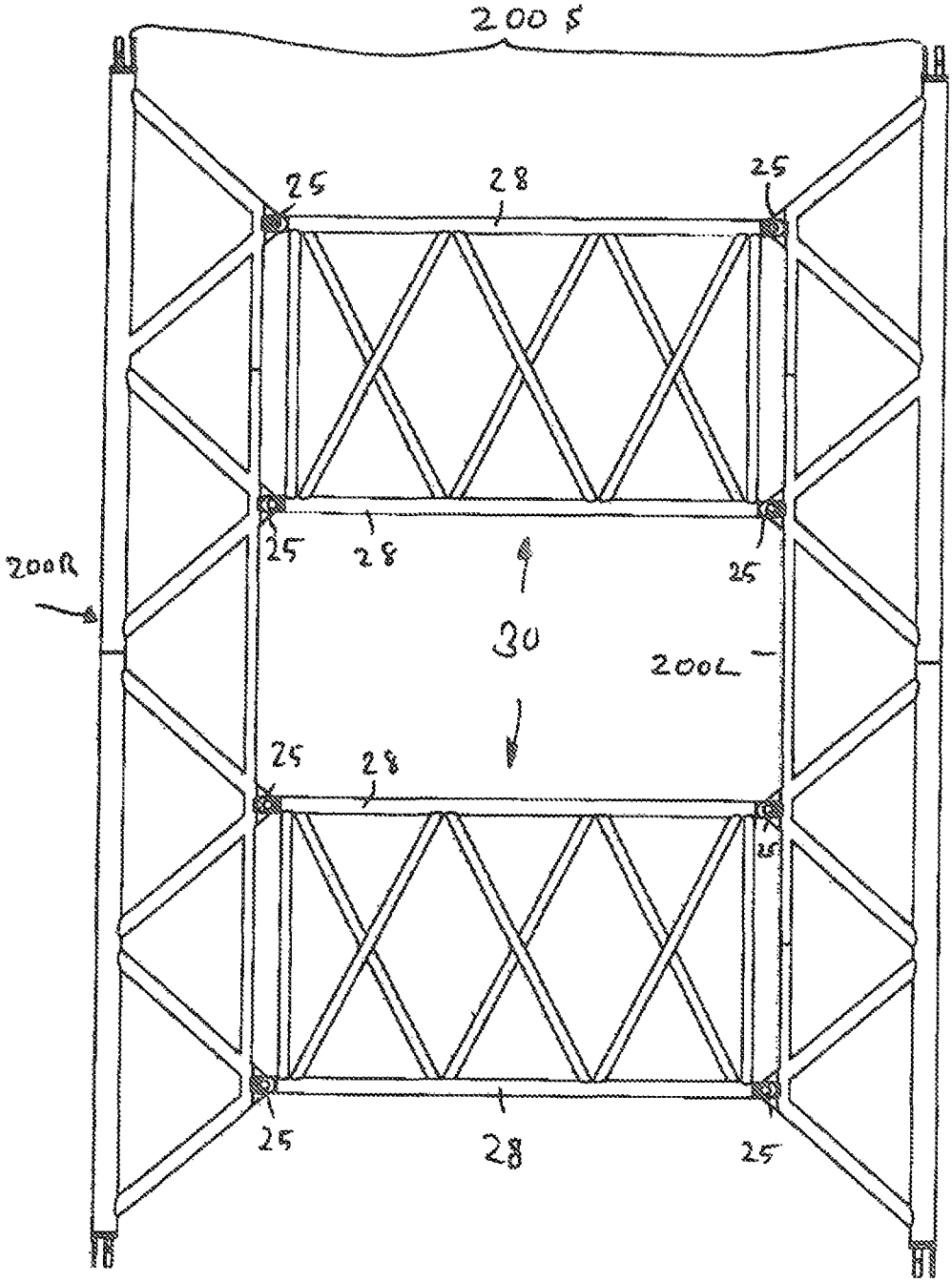
FIGS. 7*a*-7*c*: different views of the lattice piece in accordance with the invention in accordance with FIGS. 6*a* to 6*c* with inserted spacer bars.
Figure 7B:
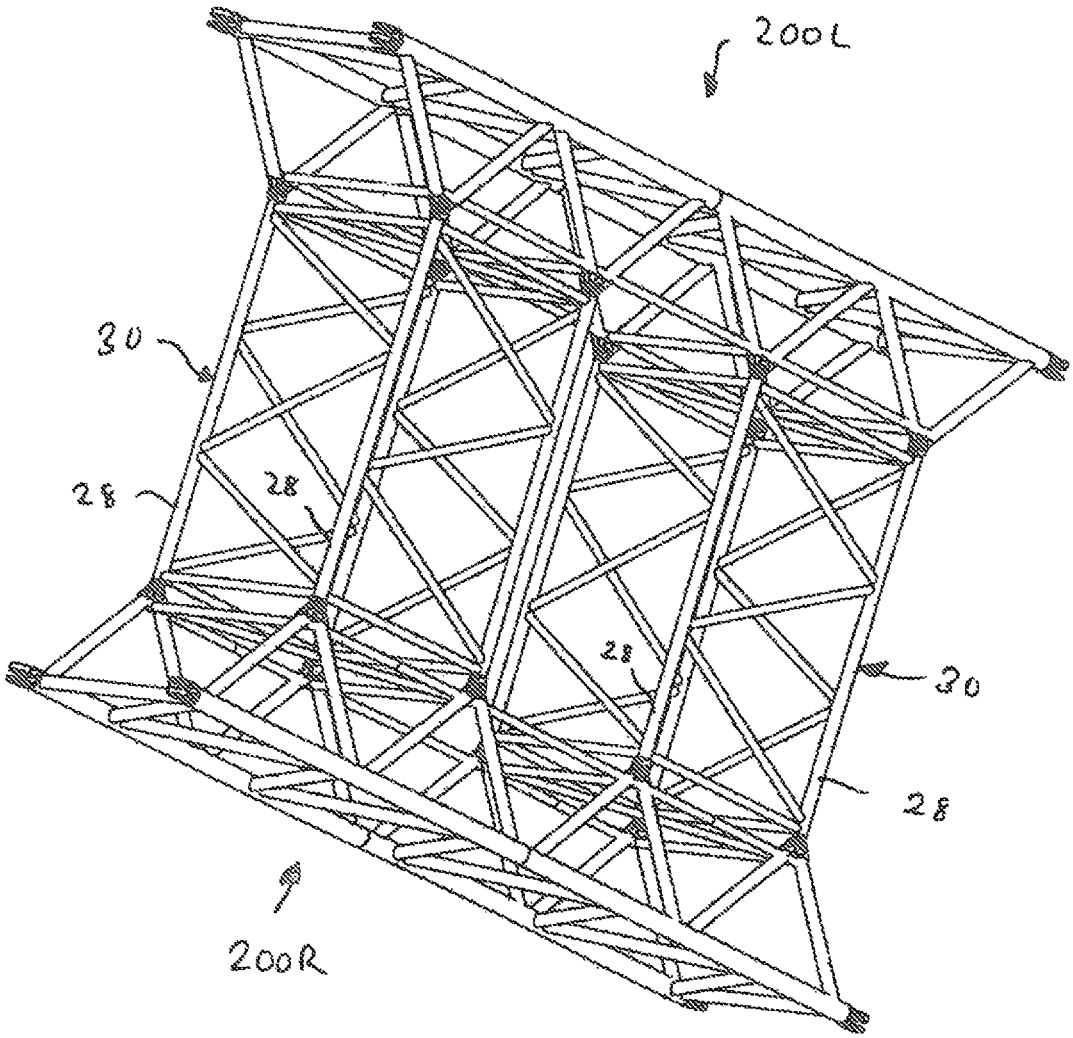
Figure 7C:
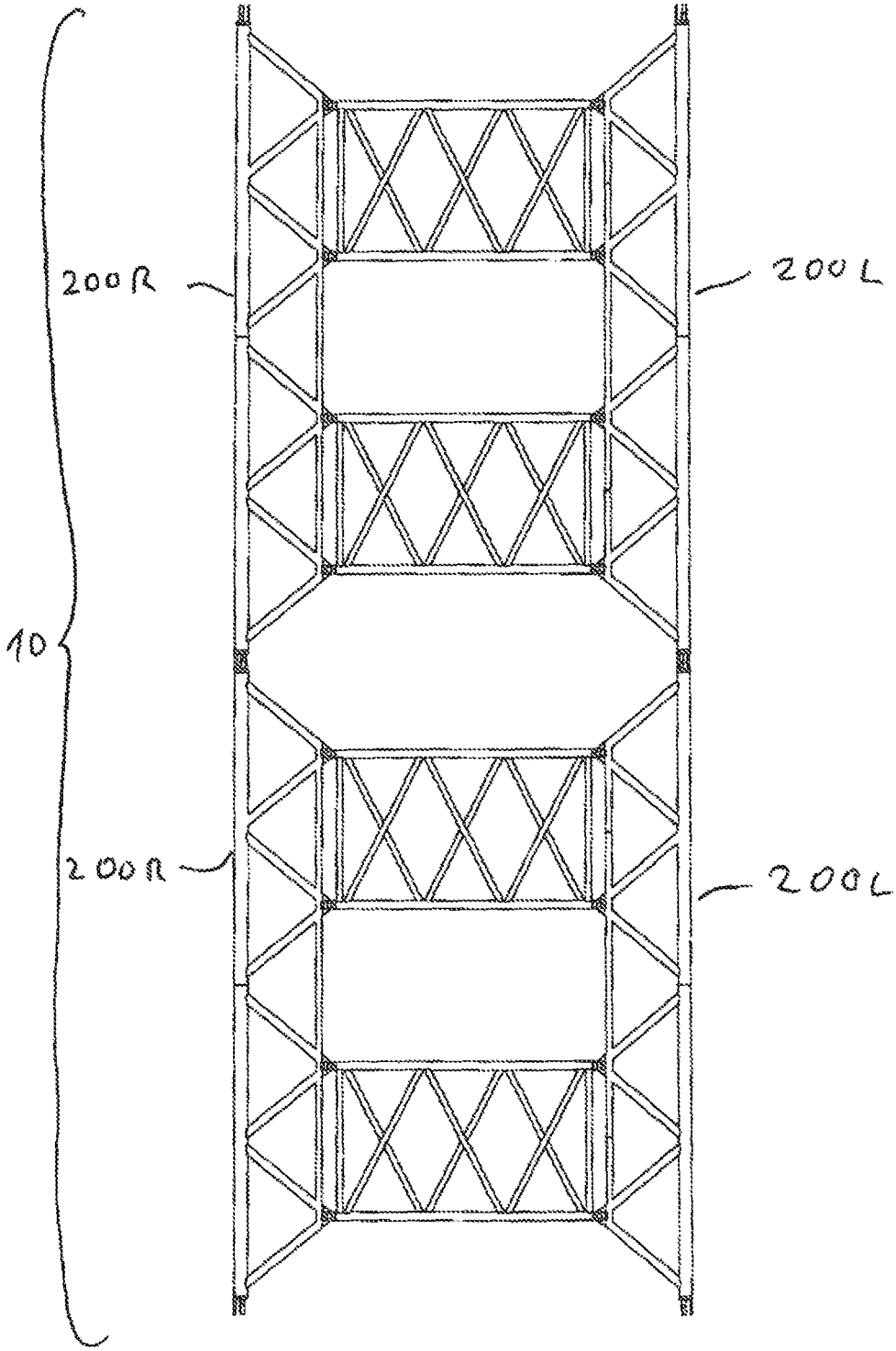

FIGS. 7*a* to 7*c* substantially correspond to the representations of FIGS. 2*a* to 2*c*, with here, however, use being made of the lattice piece 200 of the embodiment of FIGS. 6*a* to 6*c* to obtain the heavy lattice piece 200*s*.

The invention claimed is:

1. A lattice piece (2) for a crane boom (10), comprising at least two lattice piece parts (2R, 2L) which are separably connected to one another in a longitudinal direction of a luffinq plane (3) by one or more releasable connection points (26, 26'), wherein each said lattice piece (2) comprises four longitudinally-extending corner bars (21, 21', 21", 21'") forming a parallelepiped shape and having said releasable connection points (26, 26') at tips thereof, two separate tubes (24) longitudinally-extending along the luffing plane (3) in substantially parallel fashion between adjacent corner bars (21, 21', 21", 21'") along two opposite sides of said lattice piece (2), bars (22) diagonally extending to the luffing plane (3) and interconnecting each said tube (24) with an adjacent corner bar (21, 21', 21", 21'") of each said lattice piece part (2R, 2L), and connection points (25) situated at discrete locations longitudinally along said tubes (24) and at opposite longitudinal ends of said tubes (24) for interconnecting said diagonally-extending bars (22) with one another and the lattice piece parts (2R, 2L) along the longitudinal direction thereof.

2. A lattice piece in accordance with claim 1, wherein one or more lattice pieces are selectively connectable to one another via one or more spacer bars to form a wider lattice piece.

3. A lattice piece in accordance with claim 2, wherein the lattice piece parts are connectable via a respective spacer bar in the sections of the lattice parts at the bottom and at the top viewed in the longitudinal direction.

4. A lattice piece in accordance with claim 2, wherein the spatial structure of the at least one spacer bar forms a parallelepiped whose longitudinal edges are formed by four longitudinal bars which extend transversely to the longitudinal axis of the lattice piece and which are connected to one another via one or more diagonal members and/or transverse members.

5. A lattice piece in accordance with claim 1, wherein the tubes (24) of each said lattice piece (2) are additionally connected to at least one corner bar (21, 21', 21", 21'") of the lattice piece (2) via one or more unstrained members (23).

6. A lattice piece in accordance with claim 5, wherein the connection points (25) along said tubes (24) are additionally connected directly to at least some of the unstrained members (23).

7. A lattice piece in accordance with claim 6, wherein the longitudinal tubes (24) are interrupted in the longitudinal direction by the unstrained members (23).

8. A lattice piece in accordance with claim 1, wherein the longitudinal tubes (24) are interrupted in the longitudinal direction by the connection points (25) at the discrete locations therealong.

9. A lattice piece in accordance with claim 1, wherein the one or more releasable connection points (26) at the tips of the corner bars (21, 21', 21", 21'") are pinnable connections.

10. A lattice piece in accordance with claim 9, wherein the one or more releasable connection points (26) at the tips of the corner bars (21, 21', 21", 21'") are fork-finger connections.

11. A lattice piece in accordance with claim 1, wherein the corner bars (21, 21', 21", 21'") have a larger dimension than the longitudinal tubes (24).

12. A lattice piece in accordance with claim 11, wherein the corner bars (21, 21', 21", 21'") have a larger diameters and/or wall thicknesses than the longitudinal tubes (24).

13. A lattice boom having at least one lattice piece in accordance with claim 1, wherein the lattice boom is luffable in the luffing plane (3) which is vertical.

14. A lattice boom in accordance with claim 13, wherein the lattice boom has at least one first region and at least one second region, the lattice boom in the first region comprises one or more lattice pieces having lattice piece parts connected via spacer bars and in the second region it has one or more lattice pieces whose lattice piece parts are connected without or with spacer bars which are shorter with respect to the first region.

15. A lattice boom in accordance with claim 14, wherein the different regions are connected to one another via traverses and/or modified pivotal connection pieces and/or modified lattice pieces.

16. A lattice boom in accordance with claim 13, wherein a lattice boom can selectively be assembled with a constant boom width or with a boom width variable in the longitudinal direction.

17. A lattice boom in accordance with claim 13, wherein the lattice pieces (2) are storable or pushable into one another for transport purposes.

18. A lattice piece in accordance with claim 1, wherein the longitudinal tubes (24) are interrupted in the longitudinal direction by the diagonally-extending bars (22).

* * * * *